US009463618B2

(12) United States Patent
Fujii et al.

(10) Patent No.: US 9,463,618 B2
(45) Date of Patent: Oct. 11, 2016

(54) LIQUID DISCHARGE SUBSTRATE, LIQUID DISCHARGE HEAD, AND RECORDING DEVICE

(71) Applicant: CANON KABUSHIKI KAISHA, Tokyo (JP)

(72) Inventors: Kazunari Fujii, Tokyo (JP); Masanobu Ohmura, Yokohama (JP); Tatsuhito Goden, Machida (JP); Wataru Endo, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/669,678

(22) Filed: Mar. 26, 2015

(65) Prior Publication Data

US 2015/0273824 A1 Oct. 1, 2015

(30) Foreign Application Priority Data

Mar. 27, 2014 (JP) ..... 2014-067101

(51) Int. Cl.
*B41J 2/045* (2006.01)
*B41J 2/14* (2006.01)

(52) U.S. Cl.
CPC ..... *B41J 2/04541* (2013.01); *B41J 2/0458* (2013.01); *B41J 2/04548* (2013.01); *B41J 2/14072* (2013.01)

(58) Field of Classification Search
CPC .. B41J 2/04541; B41J 2/04523; B41J 2/045; B41J 2/04542; B41J 2/04548; B41J 2/4058; B41J 2/14072
See application file for complete search history.

(56) References Cited

U.S. PATENT DOCUMENTS 6,890,048 B2 * 5/2005 Hirayama ..... B41J 2/04523 257/204
9,114,615 B2 * 8/2015 Takagi ..... B41J 2/04541

FOREIGN PATENT DOCUMENTS

JP 2010-155452 A 7/2010

* cited by examiner

*Primary Examiner* — Julian Huffman
*Assistant Examiner* — Michael Konczal
(74) *Attorney, Agent, or Firm* — Canon U.S.A., Inc. IP Division

(57) ABSTRACT

A liquid discharge substrate includes a plurality of discharge elements disposed on a substrate, a first transistor electrically connected to the plurality of discharge elements, and a plurality of second transistors. The first transistor is disposed between the plurality of discharge elements and the plurality of second transistors.

19 Claims, 8 Drawing Sheets

LIQUID DISCHARGE SUBSTRATE, LIQUID DISCHARGE HEAD, AND RECORDING DEVICE

BACKGROUND OF THE INVENTION

1. Field of the Invention

The present invention relates to a liquid discharge substrate, a liquid discharge head, and a recording device.

2. Description of the Related Art

Some of the latest recording devices use a discharge element for discharging liquid, such as ink, as a recording element. In order to increase the recording speed, it has been proposed to increase the number of ink discharge openings, or nozzles, in a liquid discharge head provided with a discharge element.

As the number of the ink discharge openings is increased, the number of discharge elements on a liquid discharge substrate also increases. In Japanese Patent Application Laid-Open No. 2010-155452, a technology for driving a number of discharge elements (heaters) simultaneously is proposed. The technology is described that it enables ink to be discharged via a plurality of ink discharge holes simultaneously, achieving high speed recording.

SUMMARY OF THE INVENTION

According to an embodiment, a liquid discharge substrate includes a plurality of discharge elements; a first transistor configured to form a common electric path with respect to the plurality of discharge elements; and a plurality of second transistors configured to be controlled independently from each other. An electric path is formed from a first power supply node to a second power supply node in an order of the first transistor, one of the plurality of discharge elements, and one of the plurality of second transistors so that the plurality of discharge elements are driven by the plurality of second transistors independently from each other. The first transistor is disposed between the plurality of discharge elements and the plurality of second transistors.

According to another embodiment, a liquid discharge substrate includes: a plurality of discharge elements; a first transistor; and a plurality of second transistors. One of a source and drain of the first transistor is electrically connected to a first power supply node. The other of the source and drain of the first transistor is electrically connected to one node of each of the plurality of discharge elements. The other node of each of the plurality of discharge elements is electrically isolated from each other and electrically connected to one of a source and drain of corresponding one of the plurality of second transistors. The other of the source and drain of each of the plurality of second transistors is electrically connected to a second power supply node. Gates of the plurality of second transistors are electrically isolated from each other. The first transistor is disposed between the plurality of discharge elements and the plurality of second transistors.

Further features of the present invention will become apparent from the following description of exemplary embodiments (with reference to the attached drawings).

DESCRIPTION OF THE EMBODIMENTS

According to some of embodiments, the liquid discharge substrate can be decreased in size, and improved liquid discharge characteristics can be obtained.

In the liquid discharge head described in Japanese Patent Application Laid-Open No. 2010-155452, two transistors are provided for each of a plurality of heaters, resulting in an increase in the number of transistors. The increase in the number of transistors leads to an increase in the area in which the transistors are disposed. Thus, the liquid discharge head according to Japanese Patent Application Laid-Open No. 2010-155452 has the problem of difficulty in decreasing the size of the liquid discharge head.

Further, when the plurality of transistors are connected to each heater as in the liquid discharge head of Japanese Patent Application Laid-Open No. 2010-155452, the length of wiring connected to the heater may become long, depending on the location of the plurality of transistors. The increase in wiring length results in an increase in voltage drop, possibly decreasing the voltage applied to the heaters. As a result, the liquid discharge characteristics may be lowered.

In view of the above problems, some of the embodiments are configured to enable a decrease in the size of the liquid discharge substrate used in recording devices and the like, while improving liquid discharge characteristics.

According to an embodiment of the present invention, there is provided a liquid discharge substrate including a discharge element that discharges liquid, such as ink. According to another embodiment of the present invention, there is provided a liquid discharge head including a liquid discharge substrate and a liquid supply unit configured to supply liquid, such as ink, to the liquid discharge substrate. The liquid discharge head may provide a recording head of a recording device, for example. According to yet another embodiment of the present invention, there is provided a recording device including a liquid discharge head and a drive unit that drives the liquid discharge head. The recording device may include a printer or a copier, for example. A liquid discharge head according to an embodiment of the present invention may be applied in a device for manufacturing a three-dimensional structural member, a DNA chip, an organic transistor, a color filter and the like.

Figure 2:
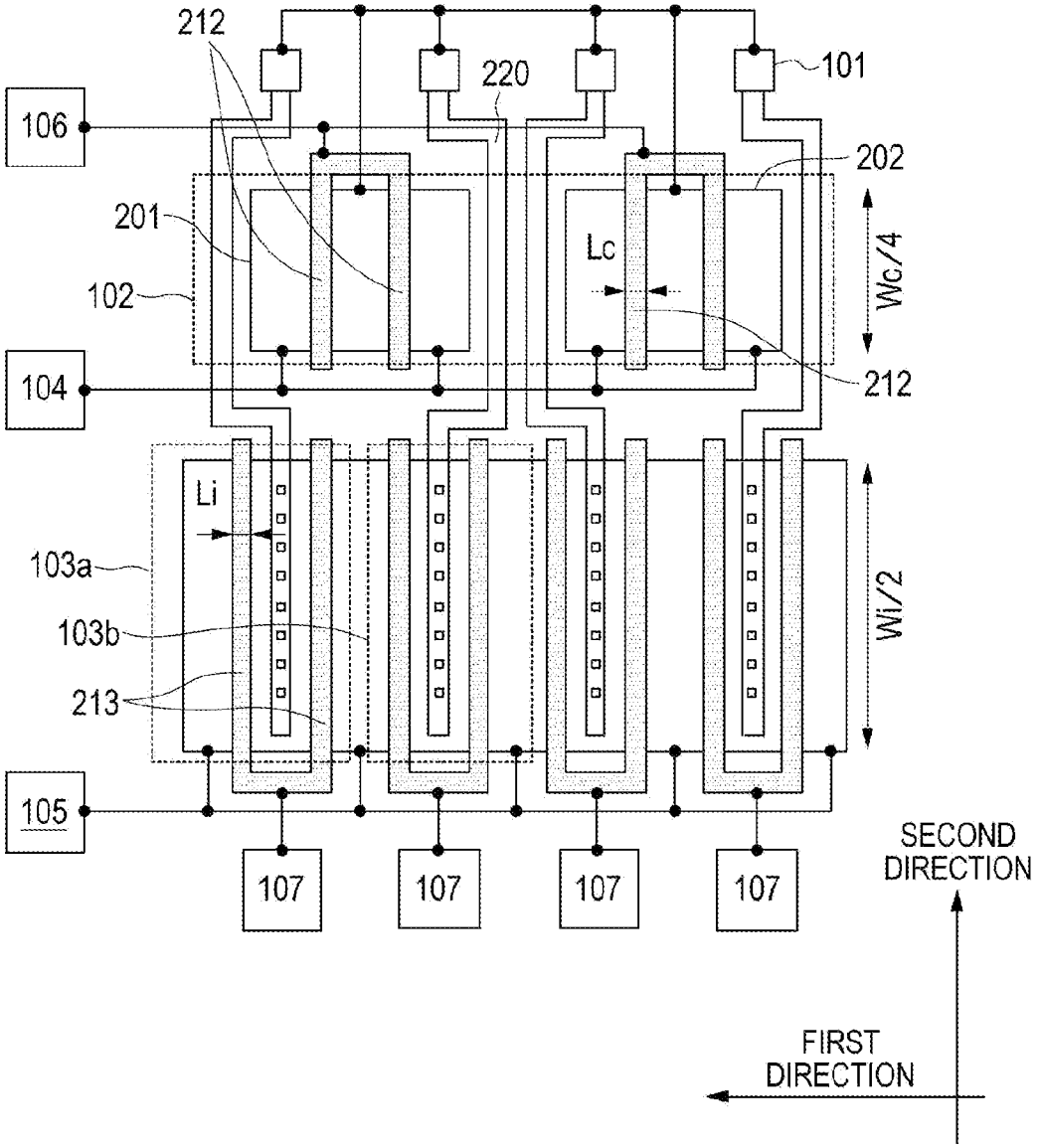
FIG. 2 is a schematic representation of the planar structure of the liquid discharge substrate.

On the liquid discharge substrate, a plurality of discharge elements is disposed. For example, FIG. 2 illustrates discharge elements 101. For the discharge elements, an element that can convert electric energy to energy for discharging liquid, such as a heater or a piezoelectric element, is used. The plurality of discharge elements is arranged along a first direction.

On the liquid discharge substrate, a first transistor and a plurality of second transistors are disposed. For example, in FIG. 2, a first transistor 102 and a plurality of second transistors 103 are illustrated. The transistors are elements in which current is controlled by an electric signal applied to a gate. For example, a single transistor includes one or a plurality of MOS transistors. When a single transistor includes a plurality of MOS transistors, the MOS transistors are controlled by a common electric signal. Specifically, in the MOS transistors, the sources are mutually connected, the drains are mutually connected, and the gates are mutually connected. The transistors may include one or a plurality of bipolar transistors. When bipolar transistors are used, the source, drain, and gate correspond to the collector, emitter, and base, respectively.

As illustrated schematically in FIG. 2, one first transistor and a plurality of second transistors are electrically connected to a plurality of discharge elements. In other words, a plurality of discharge elements shares one first transistor. Thus, the number of transistors disposed on the liquid discharge substrate can be decreased while a plurality of transistors is provided to each of a plurality of discharge elements. As a result, the liquid discharge substrate can be reduced in size.

Further, the first transistor is disposed between the plurality of discharge elements and the plurality of second transistors. Thus, when the liquid discharge substrate is viewed in plan, the first transistor and the plurality of second transistors are arranged successively in that order from the plurality of discharge elements along a second direction intersecting the first direction.

Because the first transistor is shared by the plurality of discharge elements, the number of the first transistor can be smaller than that of the plurality of second transistors. Thus, the area of the region in which the first transistor is disposed can be made smaller than the area of the region in which the second transistors are disposed. Accordingly, the distance between the second transistors and the discharge elements can be decreased, and, furthermore, the wiring connecting the second transistors and the liquid discharge elements can be reduced in length. As a result, the liquid discharge characteristics can be improved.

In the following, embodiments of the present invention will be described with reference to the drawings. Obviously, the embodiments of the present invention are not limited to the embodiments described below. For example, some of the elements of any of the following embodiments may be incorporated into another embodiment or substituted by some of the elements of the other embodiment, and such examples are also included as embodiments of the present invention.

(First Embodiment)

Figure 1A:
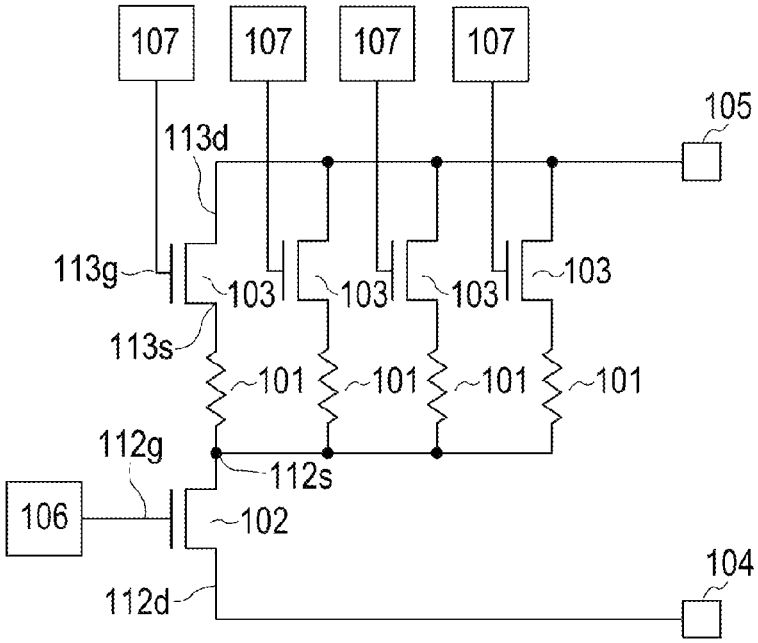
FIGS. 1A and 1B show an equivalent circuit of a liquid discharge substrate, and schematically shows a planar structure of the liquid discharge substrate.

A first embodiment will be described. FIG. 1A shows an equivalent circuit of a liquid discharge substrate according to the present embodiment. FIG. 1A shows heaters 101, a first transistor 102, second transistors 103, a first power supply node 104, a second power supply node 105, a drive unit 106, and control units 107.

The first transistor 102, the heaters 101, and the second transistors 103 are successively connected between the first power supply node 104 and the second power supply node 105. The first transistor 102 is connected to four heaters 101. In the following, for convenience sake, the first transistor will be referred to as a "common transistor". For four heaters 101, four second transistors 103 are disposed. The four heaters 101 and the four second transistors 103 are connected one-to-one. In the following, for convenience sake, the second transistors will be referred to as "individual transistors".

To the first power supply node 104 and the second power supply node 105, different voltages are supplied. The first power supply node 104 is supplied with ground voltage (0 V, for example). The second power supply node is supplied with a power supply voltage (32 V, for example).

By the connection shown in FIG. 1A, the common transistor 102 forms a common electric path with respect to the plurality of heaters 101 between the first power supply node 104 and each of the heaters 101. Each of the plurality of individual transistors 103 forms an electric path between a corresponding one of the plurality of heaters 101 and the second power supply node 105. The plurality of heaters 101 and the plurality of individual transistors 103 form a plurality of electric paths between the common transistor 102 and the second power supply node 105.

The common transistor 102 includes a gate 112*g*, a source 112*s*, and a drain 112*d*. Each of the plurality of individual transistors 103 includes a gate 113*g*, a source 113*s*, and a drain 113*d*. The drain 112*d* of the common transistor 102 is electrically connected to the first power supply node 104. The source 112*s* of the common transistor 102 is electrically connected to each of the plurality of heaters 101. With regard to the plurality of individual transistors 103, the respective source 113*s* is electrically connected to a corresponding one of the plurality of discharge elements 101, with the respective drain 113*d* being electrically connected to the second power supply node 105.

To the gate 112*g* of the common transistor 102, an electric signal is supplied from the drive unit 106. The common transistor 102 forms a source follower. By such configuration, the voltage at the source 112*s* of the common transistor 102 can be controlled based on the electric signal supplied to the gate 112*g* of the common transistor 102.

To the gate 113*g* of the individual transistors 103, a control signal is supplied from the control units 107. By the control signal supplied from the control units 107, the current that flows through the individual transistors 103 is controlled, whereby the current that flows through the heaters 101 can be controlled. Each of the individual transistors 103 forms a source follower. This configuration allows the voltage at the source 113*s* of the individual transistors 103 to be controlled on the basis of the electric signal supplied to the gate 113*g* of the individual transistors 103.

The plurality of individual transistors 103 are mutually independently controlled. In this embodiment, the control units 107 are disposed for the corresponding individual transistors 103. This configuration allows the control units 107 to control the individual transistors 103 without causing current to flow through the plurality of heaters 101 simultaneously. For example, the four individual transistors 103 can be controlled such that one of the four individual transistors 103 shown in FIG. 1 is turned on while the other three are turned off.

Figure 1B:
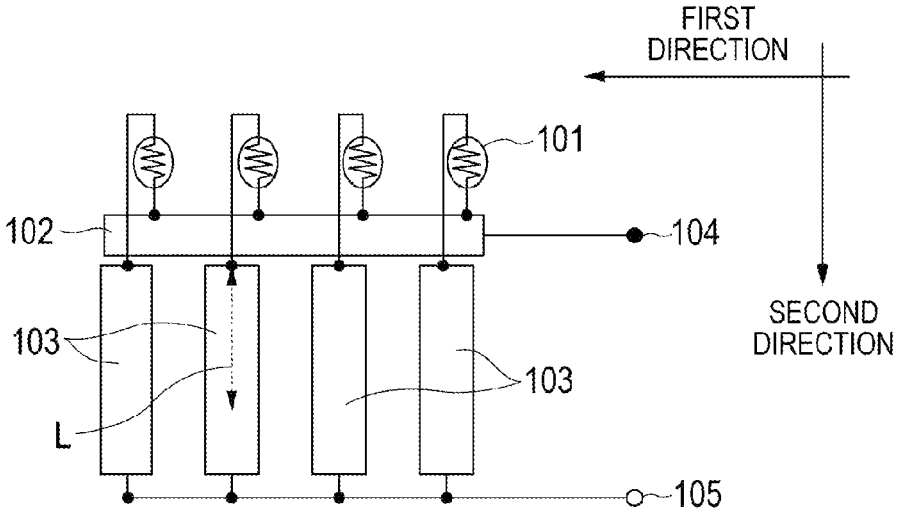

FIG. 1B schematically shows a planar structure of the liquid discharge substrate according to the present embodiment. In FIG. 1B, the same members as those of FIG. 1A are designated with the same signs.

The plurality of heaters 101 is arranged along a first direction. The first direction is the direction of the long sides of the liquid discharge substrate, for example. A direction intersecting the first direction is a second direction. While in FIG. 1B the plurality of heaters 101 are arranged linearly, they may be staggered from one another in the second direction.

With reference to the row of the plurality of heaters 101, the common transistor 102 and the plurality of individual transistors 103 are disposed on one side of the substrate. Such arrangement facilitates the location of an ink supply opening (not shown) for supplying ink near the heaters 101.

Along the second direction, the common transistor 102 and the plurality of individual transistors 103 are arranged successively in that order from the plurality of heaters 101.

Namely, the common transistor 102 is disposed between the plurality of heaters 101 and the plurality of individual transistors 103. The heaters 101 and the common transistor 102 are connected by connection wire drawn from the heater 101 side of the common transistor 102. The plurality of individual transistors 103 are arranged along the first direction. The heaters 101 and the individual transistors 103 are connected by connection wire drawn from the side of the individual transistors 103 closer to the heaters 101. The connection wire connecting the heaters 101 and the individual transistors 103 is run across the region in which the common transistor 102 is disposed along the second direction.

The common transistor 102 and the individual transistors 103 are respectively disposed in rectangular regions. The region in which the common transistor 102 is disposed is a rectangle with long sides along the first direction. Because the single common transistor 102 is disposed with respect to the plurality of heaters 101, the length of the long sides is longer than the interval of the heaters 101. On the other hand, the regions in which the individual transistors 103 are disposed are rectangles with the long sides along the second direction. One individual transistor 103 is disposed for each of the heaters 101. Thus, the length of the region in which the common transistor 102 is disposed along the first direction is equal to the interval of the heaters 101.

Specifically, for the four individual transistors 103, one common transistor 102 is provided. Thus, in the first direction, the length of the region in which the common transistor 102 is disposed is approximately four times the length of the regions in which the individual transistors 103 are disposed. In the second direction, the length of the region in which the common transistor 102 is disposed is approximately one fourth the length of the regions in which the individual transistors 103 are disposed.

This arrangement enables a decrease in the length of the connection wire connecting the heaters 101 and the individual transistors 103. Thus, when current flows through the heaters 101, the voltage drop due to the resistance of the connection wire can be decreased, whereby more electric power can be supplied to the heaters 101. As a result, the discharge characteristics can be improved.

When the plurality of individual transistors 103 is disposed near the heaters 101 in a modification, wiring length will be increased by a distance indicated by dotted line arrow L in FIG. 1B. This is because the connection wire connecting the heaters 101 and the common transistor 102 will be run across the region in which the individual transistors 103 are disposed along the second direction.

According to the present embodiment, the one common transistor 102 is shared by the plurality of heaters 101. This configuration enables a decrease in the number of the transistors disposed on the liquid discharge substrate. As a result, the size of the liquid discharge substrate can be decreased.

While in the present embodiment the number of the heaters 101 is four for ease of description, the number of the heaters 101 may be more than four. In the present embodiment, the common transistor 102 includes a P-channel MOS transistor, while the individual transistors 103 include N-channel MOS transistors. Alternatively, the common transistor 102 and the individual transistors 103 may each include an N-channel MOS transistor. The connection is not limited to the one illustrated in FIG. 1. For example, one of the source and drain of the common transistor 102 may be electrically connected to the first power supply node 104 and the other of the source and drain of the common transistor 102 may be electrically connected to the plurality of heaters 101. One of the source and drain of the individual transistors 103 may be electrically connected to the second power supply node 105, and the other of the source and drain of the individual transistors 103 may be electrically connected to the heaters 101.

As shown in FIG. 1B, the common transistor 102 is disposed between the plurality of heaters 101 and the plurality of individual transistors 103. The layout enables a decrease in the length of the wiring connecting the individual transistors 103 and the control units 107. A decrease in wiring parasitic capacitance enables an increase in drive speed.

(Second Embodiment)

Another embodiment will be described. The present embodiment is characterized by MOS transistors included in the common transistor 102, MOS transistors included in the individual transistors 103, and the layout of the connection wire connecting the heaters 101 and the individual transistors 103. Thus, the following description focuses on the difference from the first embodiment and omits description of portions similar to those of the first embodiment.

FIG. 2 schematically shows a planar structure of a liquid discharge substrate according to the present embodiment. Portions having the same functions as those of FIG. 1 are designated with the same signs. The present embodiment has the same equivalent circuit as that of the first embodiment. Namely, the equivalent circuit of the present embodiment is shown in FIG. 1A.

The common transistor 102 includes four common MOS transistors 212 arranged along the first direction. While in FIG. 2 the sign may be pointing to gate electrodes, the common MOS transistors 212 include gates, sources, and drains. As shown in FIG. 2, the gates of the four common MOS transistors 212 included in the common transistor 102 are mutually connected. The drains of the four common MOS transistors 212 are mutually connected. The sources of the four common MOS transistors 212 are also mutually connected.

The four common MOS transistors 212 included in the common transistor 102 are separately disposed in two different active regions 201 and 202. The active region 201 and the active region 202 are respectively defined by field regions. The field regions are insulating isolation structures by LOCOS or STI, for example. The two common MOS transistors 212 disposed in each of the active region 201 and the active region 202 mutually share a semiconductor region forming the source. In FIG. 2, the semiconductor region forming the source of the common MOS transistors 212 is connected to the heaters 101.

The channel direction of each of the plurality of common MOS transistors 212 included in the common transistor 102 is along the first direction. When the channel direction is along the first direction, the wiring connected to a main electrode node of the common transistor 102 can be easily drawn out along the second direction.

Each of the plurality of individual transistors 103 includes two individual MOS transistors 213 arranged along the first direction. While in FIG. 2 the sign may be pointing to gate electrodes, the individual MOS transistors 213 include gates, sources, and drains. As shown in FIG. 2, the gates of the two individual MOS transistors 213 included in one individual transistor 103 are mutually connected. The drains of the two individual MOS transistors 213 are mutually connected. The sources of the two individual MOS transistors 213 are also mutually connected.

In FIG. 2, in order to distinguish the two individual transistors 103, the individual transistors are designated with signs 103*a* and 103*b* for convenience sake. The two individual MOS transistors 213 included in the individual transistors 103*a* share a semiconductor region for the source. The individual MOS transistors 213 included in the individual transistors 103*a* and the individual MOS transistors 213 included in the individual transistors 103*b* share a semiconductor region for the drain. In this way, the four individual transistors 103 are disposed in one active region.

The channel direction of each of the plurality of individual MOS transistors 213 included in one individual transistor 103 is along the first direction. When the channel direction is in the first direction, the wiring connected to the main electrode node of the individual transistors 103 can be easily drawn out along the second direction.

The sources of the individual MOS transistors 213 are connected to the heaters 101 by connection wires 220 included in a first wiring layer. As shown in FIG. 2, the connection wires 220 include portions extending along the second direction. The portions of the connection wires 220 extending along the second direction are disposed between two adjacent common MOS transistors 212 as viewed in plan.

The gates of the plurality of common MOS transistors 212 are connected to the drive unit 106 by the wiring of a wiring layer over the first wiring layer. The drains of the plurality of common MOS transistors 212 are connected to the first power supply node 104 by the wiring of a wiring layer over the first wiring layer.

The gates of the plurality of individual MOS transistors 213 are connected to the control units 107 by the wiring of a wiring layer over the first wiring layer. The drains of the plurality of individual MOS transistors 213 are connected to the second power supply node 105 by the wiring of a wiring layer over the first wiring layer.

In the following, driving power of the one common transistor 102 connected to the heaters 101 and the individual transistors 103 will be described. The driving power of a transistor is determined by the effective channel length and the effective channel width.

The common MOS transistors 212 included in the common transistor 102 have a channel width Wc/4 and a channel length Lc. The four common MOS transistors 212 are connected in parallel. Thus, the effective channel length of the common transistor 102 is equal to the channel length Lc of the common MOS transistors 212. The effective channel width of the common transistor 102 is four times the channel width Wc/4 of the common MOS transistors 212. Namely, the common transistor 102 has the effective channel width Wc. Accordingly, the driving power of the common transistor 102 is expressed by Wc/Lc.

The individual MOS transistors 213 included in the individual transistors 103 have a channel width Wi/2 and a channel length Li. The two individual MOS transistors 213 are connected in parallel. Thus, the effective channel length of the individual transistors 103 is equal to the channel length Li of the individual MOS transistors 213. The effective channel width of the individual transistors 103 is twice the channel width Wi/2 of the individual MOS transistors 213. Namely, the individual transistors 103 have the effective channel width Wi. Accordingly, the driving power of the individual transistors 103 is expressed by Wi/Li.

When a particular transistor consists of a single transistor, the effective channel width and the effective channel length of the particular transistor is respectively equal to the channel width and the channel length of the single transistor. When the particular transistor includes two transistors connected in series, the effective channel length of the particular transistor is the sum of the channel lengths of the two transistors.

According to the present embodiment, the common transistor 102 and the individual transistors 103 have substantially the same driving power; namely, Wc/Lc=Wi/Li. Further, the channel length Lc of the common MOS transistors 212 is equal to the channel length Li of the individual MOS transistors 213. Thus, the channel width We/4 of the common MOS transistors 212 is one half the channel width Wi/2 of the individual MOS transistors 213. Accordingly, the length of the connection wires 220 connecting the heaters 101 and the individual transistors 103 can be decreased. As a result, the discharge characteristics can be improved.

The driving power may also be changed by carrier mobility or gate insulating film capacitance. According to the present embodiment, the carrier mobility and gate insulating film capacitance of the common MOS transistors 212 are respectively equal to the carrier mobility and gate insulating film capacitance of the individual MOS transistors 213. These characteristics may be mutually different.

As another example, an embodiment will be described in which the driving power of the common transistor 102 is greater than the driving power of the individual transistors 103. Specifically, the relationship Wc/Lc>Wi/Li is satisfied. When the sum of the driving power of the common transistor 102 and the driving power of the individual transistors 103 is increased, the discharge characteristics are improved. By making the driving power of the common transistor 102 greater as described above, an increase in the area of the liquid discharge substrate can be suppressed compared with when the driving power of both is equally increased.

For example, the length of the liquid discharge substrate along the second direction is increased only by A, and the channel width of the common MOS transistors 212 is increased only by A. In this case, the effective channel width W' of the common transistor 102 is expressed by the following expression (1). Thus, the increase in driving power is 4A/Lc.

[Expression 1]

$$W_c' = \left(\frac{W_c}{4} + A\right) \times 4 = W_c + 4A \tag{1}$$

Next, the length of the liquid discharge substrate along the second direction is increased only by A, and the channel width of the individual MOS transistors 213 is increased only by A. In this case, the effective channel width W' of the individual transistors 103 is expressed by the following expression (2). Thus, the increase in the driving power is 2A/Li.

[Expression 2]

$$W_i' = \left(\frac{W_i}{2} + A\right) \times 2 = W_i + 2A \tag{2}$$

When the effective channel length Lc of the common transistor 102 is equal to the effective channel length Li of the individual transistors 103 (Lc=Li), the driving power can be increased more by increasing the channel width of the common MOS transistors 212. Namely, when Wc/Lc>Wi/

Li, the discharge characteristics can be improved while an increase in the area of the liquid discharge substrate is suppressed.

(Third Embodiment)

Another embodiment will be described. The present embodiment is characterized by a plurality of heater blocks and the layout of a power supply wiring forming a power supply node. Thus, the following description focuses on the difference from the first embodiment and the second embodiment, and omits description of portions similar to those of the first embodiment or the second embodiment.

Figure 3A:
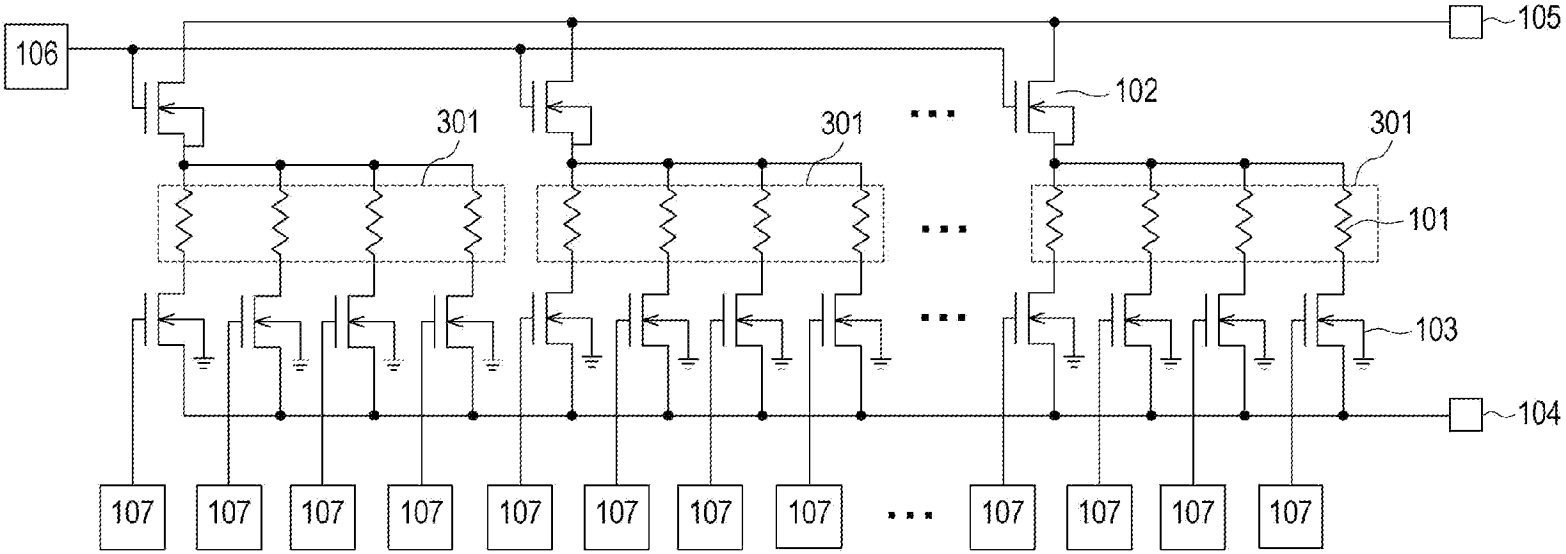
FIGS. 3A-3C show an equivalent circuit of the liquid discharge substrate, and schematically shows a planar structure of the liquid discharge substrate.

FIG. 3A shows an equivalent circuit of the liquid discharge substrate according to the present embodiment. Portions having the same functions as those of FIG. 1 are designated with the same signs. While there are shown a plurality of heaters 101, a plurality of common transistors 102, and a plurality of individual transistors 103, signs may be omitted as needed for simplicity.

In the present embodiment, a plurality of heater blocks 301 is disposed. Each heater block 301 includes four heaters 101. Each heater block 301 has the same equivalent circuit as that of the first embodiment. Thus, detailed description will be omitted.

The plurality of common transistors 102 is disposed corresponding to the plurality of heater blocks 301. The gates of the plurality of common transistors 102 are connected to the drive unit 106. The configuration is such that a common electric signal is supplied from the drive unit 106 to the gates of the plurality of common transistors 102.

In this configuration, the number of recording elements can be increased, and a number of the recording elements can be driven simultaneously. As a result, high speed recording can be performed.

Figure 3B:
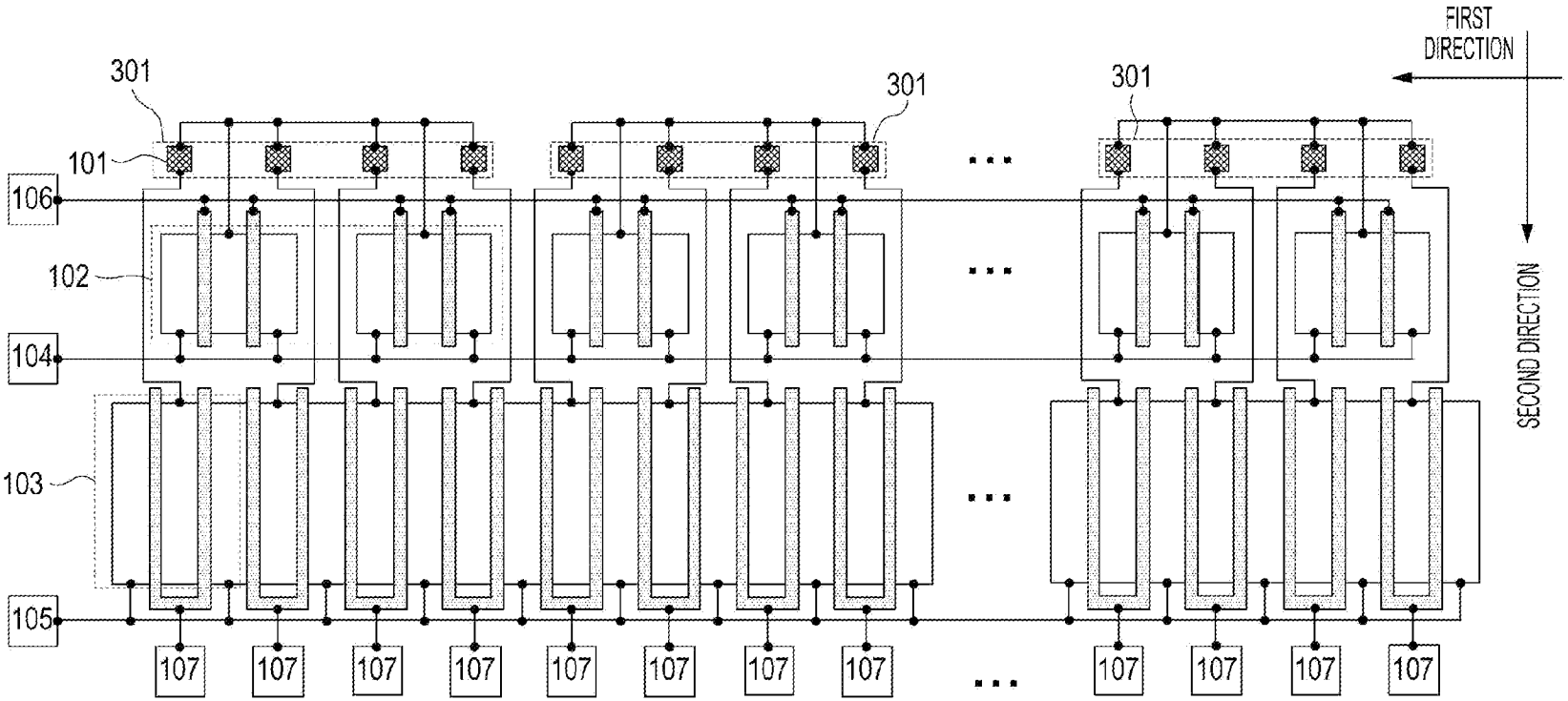

FIG. 3B schematically shows a planar structure of the liquid discharge substrate according to the present embodiment. Portions having the same functions as those of FIG. 2 are designated with the same signs. As shown in FIG. 3B, the plurality of individual transistors 103 corresponding to the plurality of heater blocks 301 is disposed in one active region. The other structures are similar to those of the second embodiment.

Figure 3C:
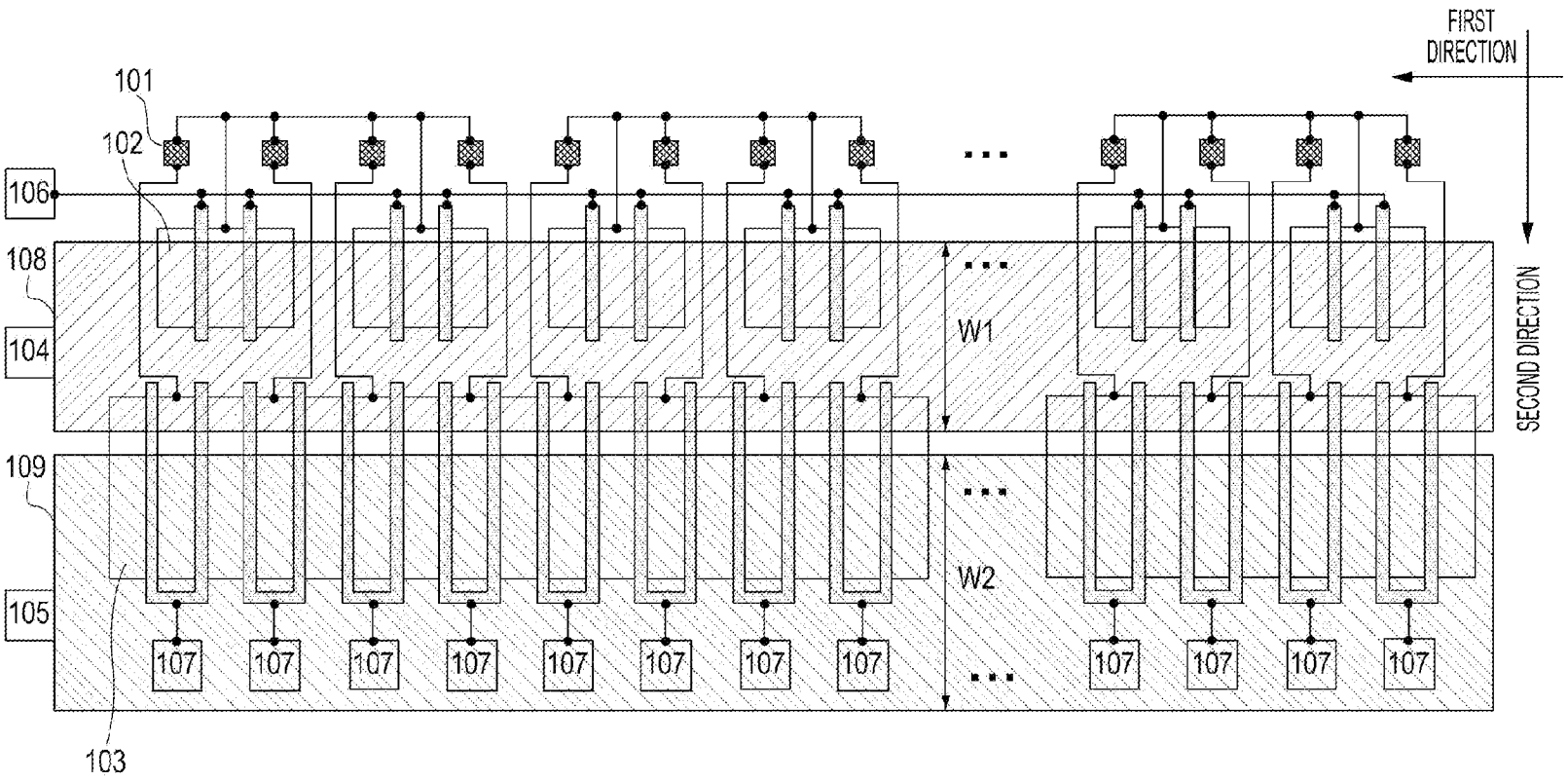

FIG. 3C schematically shows a planar structure of the liquid discharge substrate according to the present embodiment. Portions having the same functions as those of FIG. 2 are designated with the same signs.

FIG. 3C shows a power supply wiring 108 forming the first power supply node 104, and a power supply wiring 109 forming the second power supply node 105. As shown in FIG. 3C, the power supply wiring 108 and the power supply wiring 109 are successively arranged in that order from the heaters 101. Namely, as viewed in plan, the power supply wiring 108 is disposed between a row of the plurality of heaters 101 and the power supply wiring 109. This arrangement enables the common transistor 102 and the power supply wiring 108 to be positioned close to each other. Further, the positions of the individual transistors 103 and the power supply wiring 109 become nearer to each other. As a result, connection of the common transistor 102 and the first power supply node 104, or connection of the individual transistors 103 and the first power supply node 104 can be facilitated.

A width W1 of the power supply wiring 108 along the second direction is smaller than a width W2 of the power supply wiring 109 along the second direction. In this configuration, the voltage drop between the second power supply node 105 and the individual transistors 103 can be decreased. Particularly, when Wc/Lc>Wi/Li, as in the second embodiment, the voltage drop decreasing effect is significant. This is because the influence of a relative decrease in the driving power of the individual transistors 103 can be compensated for by a decrease in the resistance of the power supply wiring 109.

(Fourth Embodiment)

An embodiment of a recording device according to the present invention will be described. Herein, an inkjet-type recording device will be described. The recording device includes a recording head with an inkjet recording head base member 808. On the inkjet recording head base member 808, there are formed the heaters 101 as recording elements; the common transistor 102; the individual transistors 103; the first power supply node 104; and the second power supply node 105. As the inkjet recording head base member 808, the liquid discharge substrate described with reference to the first to the third embodiments may be used.

Figure 4A:
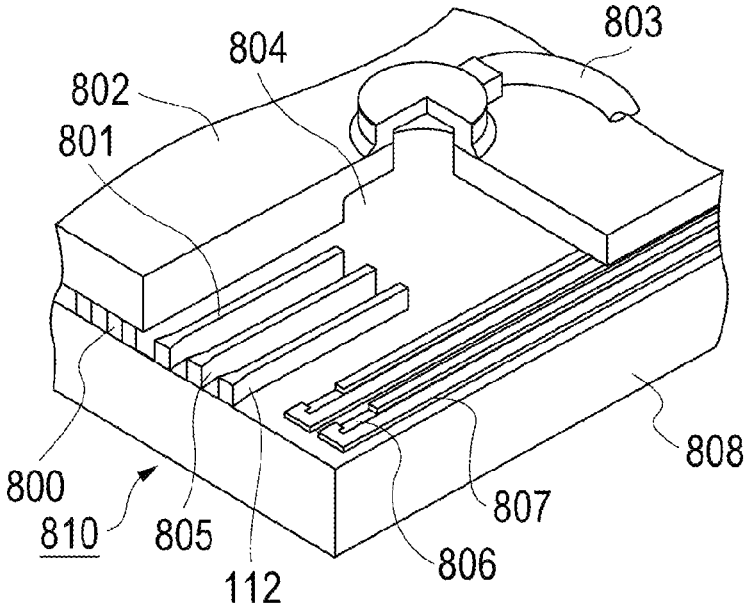
FIGS. 4A-4D illustrate a configuration of a liquid discharge head, a recording device, and a recording device control circuit.

FIG. 4A shows a major portion of the recording head 810 including the above-described inkjet recording head base member 808. The recording head 810 is provided with an ink supply opening 803. The heaters 101 according to the first through the third embodiments are depicted as a heat generating portion 806. As shown in FIG. 4A, the base member 808 may be assembled with a flow passageway wall member 801 forming fluid passageways 805 in communication with a plurality of discharge openings (or nozzles) 800, and with a top plate 802 including the ink supply opening 803, forming the recording head 810. In this case, ink is injected via the ink supply opening 803 and stored in an internal common fluid chamber 804, from which the ink is supplied to the respective fluid passageways 805. In this state, the base member 808 and the heat generating portion 806 are driven so as to discharge the ink via the discharge openings 800.

Figure 4B:
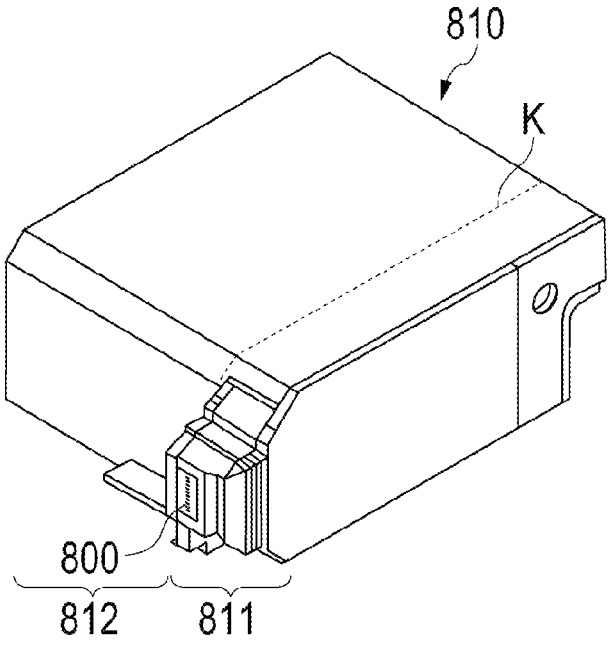

FIG. 4B shows an overall configuration of the recording head 810. The recording head 810 includes a recording head portion 811 having the plurality of discharge openings 800, and an ink container 812 for holding the ink supplied to the recording head portion 811. The ink container 812 is detachably mounted to the recording head portion 811 along a boundary line K. The recording head 810 is fitted with an electric contact (not shown) for receiving an electric signal from the carriage side when mounted on the recording device shown in FIG. 4C. Based on the electric signal, the heat generating portion 806 generates heat. The ink container 812 contains a fibrous or porous ink absorber for holding ink. The ink is thus held by the ink absorber.

The recording head 810 shown in FIG. 4B is fitted to the body of the inkjet-type recording device, and the signal supplied from the body to the recording head 810 is controlled. Thus, the inkjet-type recording device can perform high speed and high image quality recording. In the following, the inkjet-type recording device using the recording head 810 will be described.

Figure 4C:
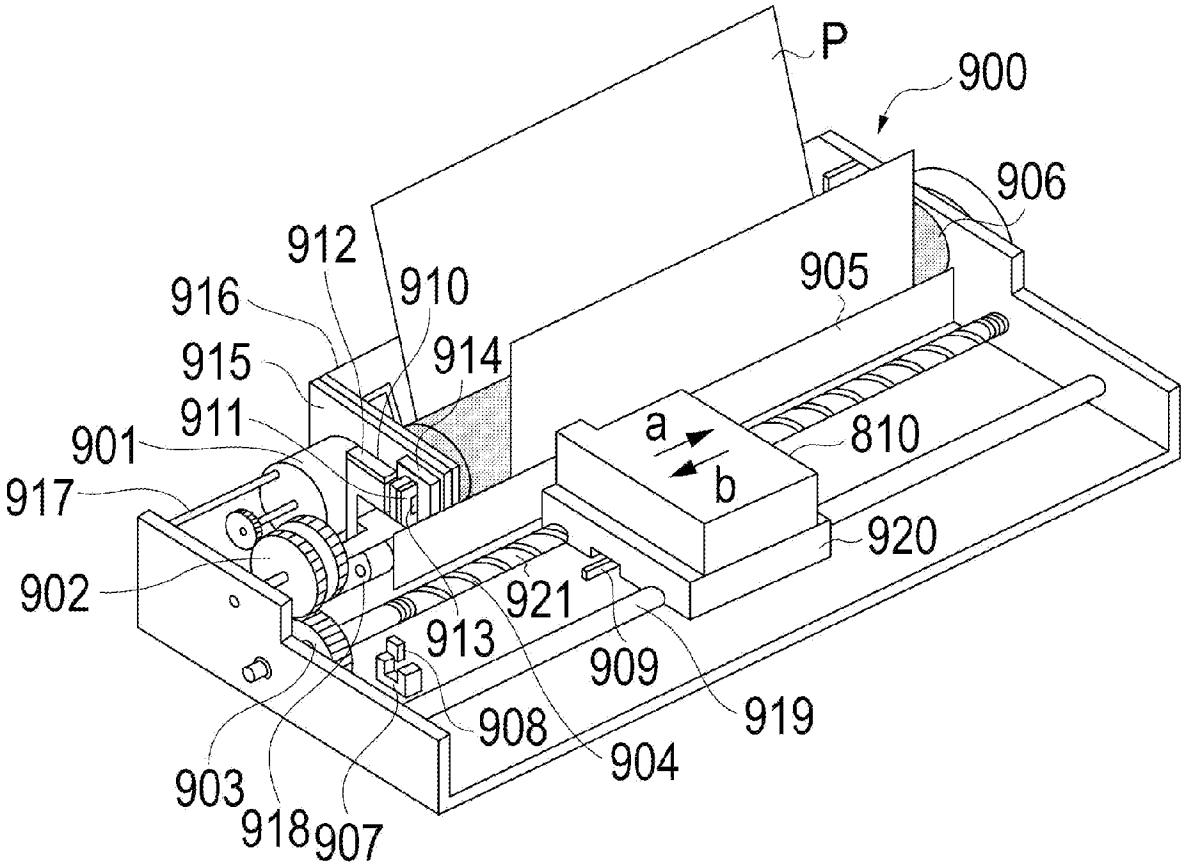

FIG. 4C is an exterior perspective view of an inkjet-type recording device 900 according to an embodiment of the present invention. In FIG. 4C, the recording head 810 is mounted on a carriage 920 engaged with a spiral groove 921 on a lead screw 904. The lead screw 904 is rotated via driving power transmitting gears 902 and 903 as the drive motor 901 is rotated in forward or reverse direction. In this configuration, the recording head 810 can be reciprocated in arrow directions a and b along a guide 919 by the driving power of the drive motor 901, together with the carriage 920. A sheet of recording paper P is transported on a platen 906 by a recording medium feeder device, which is not shown.

The sheet of recording paper P is pressed onto the platen 906 by a sheet pressing plate 905 along the direction of carriage movement.

Photo couplers 907 and 908 are home position sense means for, e.g., switching the direction of rotation of the drive motor 901 by confirming the presence of a lever 909, fitted to the carriage 920, at the region where the photo couplers 907 and 908 are disposed. A support member 910 supports a cap member 911 for capping the front surface of the recording head 810. A suction means 912 suctions the inside of the cap member 911 so as to perform suctioning recovery of the recording head 810 via a cap opening 913. A moving member 915 allows a cleaning blade 914 to be movable in front or rear direction. The cleaning blade 914 and the moving member 915 are supported by a body support plate 916. Obviously, the cleaning blade 914 may not be in the form illustrated in the drawing, and a well-known cleaning blade may be applied to the present embodiment. A lever 917 is provided to start the suction for suctioning recovery. The lever 917 is moved by the movement of a cam 918 engaged with the carriage 920, where the movement of the lever 917 is controlled by a known means for transmitting driving power from the drive motor 901, such as a clutch switching. A recording control unit (not shown) that provides a signal to the heat generating portion 806 of the recording head 810, and that drivingly controls various mechanisms, such as the drive motor 901, is disposed on the device body side.

The inkjet-type recording device 900 configured as described above performs recording on the sheet of recording paper P transported on the platen 906 by the recording medium feeder device, as the recording head 810 is reciprocated across the entire width of the sheet of recording paper P. Because the recording head 810 employs the base member for the inkjet recording head according to the first through the third embodiments, the recording head is small in size and capable of high speed recording.

Figure 4D:
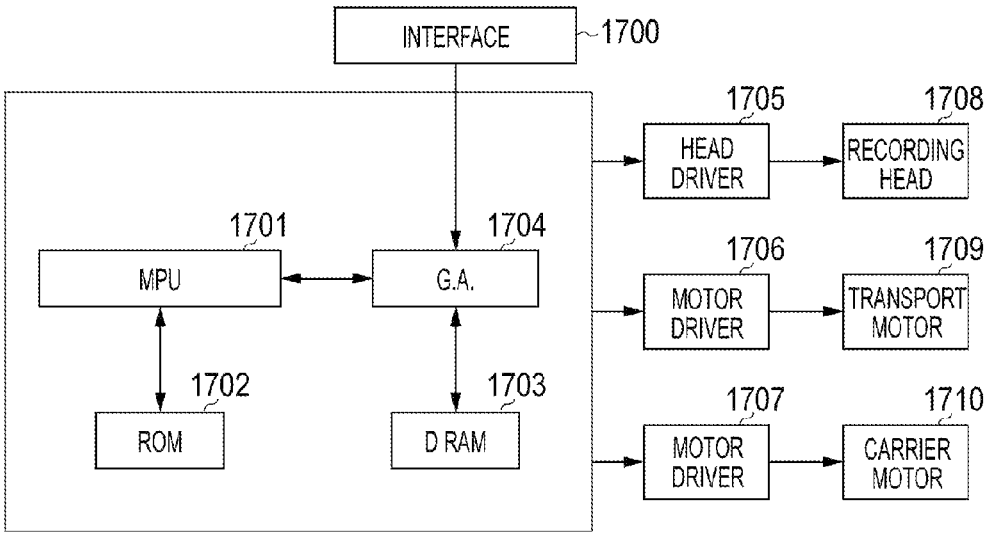

Next, the configuration of a control circuit for executing recording control of the above-described device will be described. FIG. 4D is a block diagram of the configuration of the control circuit of the inkjet-type recording device 900. The control circuit includes an interface 1700 for the input of a recording signal; a microprocessor unit (MPU) 1701; a program ROM 1702; a dynamic random access memory (RAM) 1703; and a gate array 1704. The program ROM 1702 stores a control program executed by the MPU 1701. The dynamic RAM 1703 stores the recording signal and various data such as recording data supplied to the head. The gate array 1704 performs supply control of the recording data to the recording head 1708. The gate array 1704 also performs data transfer control between the interface 1700, the MPU 1701, and the RAM 1703. The control circuit further includes a carrier motor 1710 for transporting the recording head 1708, and a transport motor 1709 for transporting the recording paper. The control circuit also includes a head driver 1705 for driving the head 1708, and motor drivers 1706 and 1707 for respectively driving the transport motor 1709 and the carrier motor 1710.

The operation of the control configuration will be described. When the recording signal is input to the interface 1700, the recording signal is converted to printing recording data between the gate array 1704 and the MPU 1701. The motor drivers 1706 and 1707 are driven, and the recording head is driven in accordance with the recording data sent to the head driver 1705, whereby printing is performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-067101, filed Mar. 27, 2014, which is hereby incorporated by reference herein in its entirety.

What is claimed is:

1. A liquid discharge substrate comprising:

a plurality of discharge elements;

a first transistor configured to form a common electric path with respect to the plurality of discharge elements; and a plurality of second transistors configured to be controlled independently from each other, wherein an electric path is formed from a first power supply node to a second power supply node in an order of the first transistor, one of the plurality of discharge elements, and one of the plurality of second transistors so that the plurality of discharge elements are driven by the plurality of second transistors independently from each other, and the first transistor is disposed between the plurality of discharge elements and the plurality of second transistors.

2. The liquid discharge substrate according to claim 1, wherein an effective channel width Wc and an effective channel length Lc of the first transistor, and an effective channel width Wi and an effective channel length Li of the second transistor satisfy an expression (1):

$$Wc/Lc>Wi/Li \quad (1).$$

3. The liquid discharge substrate according to claim 1, comprising:

a first wiring extending along a first direction in which the plurality of discharge elements are arranged, and forming the first power supply node; and a second wiring extending along the first direction and forming the second power supply node, wherein the first wiring is disposed between the plurality of discharge elements and the second wiring as viewed in plan.

4. The liquid discharge substrate according to claim 3, wherein a width W1 of the first wiring along a second direction intersecting the first direction is smaller than a width W2 of the second wiring along the second direction.

5. The liquid discharge substrate according to claim 1, comprising a control unit configured to control the plurality of second transistors independently from each other, wherein the first transistor and the plurality of second transistors are disposed between the plurality of discharge elements and the control unit.

6. The liquid discharge substrate according to claim 1, wherein the first transistor includes a plurality of first MOS transistors arranged along a direction in which the plurality of discharge elements are arranged, gates of the plurality of first MOS transistors are mutually connected, sources of the plurality of first MOS transistors are mutually connected, and drains of the plurality of first MOS transistors are mutually connected.

7. The liquid discharge substrate according to claim 6, comprising a connection wire electrically connecting one of the plurality of second transistors and one of the plurality of discharge elements, wherein the connection wire extends along a direction intersecting the direction in which the plurality of discharge elements are arranged, and includes a portion disposed between adjacent two of the plurality of first MOS transistors as viewed in plan.

8. The liquid discharge substrate according to claim 7, wherein adjacent two of the plurality of first MOS transistors are respectively disposed in two different active regions.

9. The liquid discharge substrate according to claim 6, wherein any two of the plurality of first MOS transistors share a semiconductor region forming the source or drain.

10. The liquid discharge substrate according to claim 6, wherein a channel direction of the plurality of first MOS transistors is along the direction in which the plurality of discharge elements are arranged.

11. The liquid discharge substrate according to claim 1, wherein each of the plurality of second transistors includes a plurality of second MOS transistors arranged along a direction in which the plurality of discharge elements are arranged, gates of the plurality of second MOS transistors are mutually connected, sources of the plurality of second MOS transistors are mutually connected, and drains of the plurality of second MOS transistors are mutually connected.

12. The liquid discharge substrate according to claim 11, wherein any two of the plurality of second MOS transistors share a semiconductor region forming the source or drain.

13. The liquid discharge substrate according to claim 11, wherein a channel direction of the plurality of second MOS transistors is along the direction in which the plurality of discharge elements are arranged.

14. The liquid discharge substrate according to claim 1, wherein the plurality of second MOS transistors are disposed in one active region.

15. A liquid discharge head comprising:

the liquid discharge substrate according to claim 1; and a liquid supply unit configured to supply a liquid to the liquid discharge substrate.

16. A recording device comprising:

the liquid discharge head according to claim 15; and a drive unit configured to drive the liquid discharge head.

17. A liquid discharge substrate comprising:

a plurality of discharge elements;

a first transistor; and a plurality of second transistors, wherein one of a source and drain of the first transistor is electrically connected to a first power supply node, the other of the source and drain of the first transistor is electrically connected to one node of each of the plurality of discharge elements, the other node of each of the plurality of discharge elements is electrically isolated from each other and electrically connected to one of a source and drain of corresponding one of the plurality of second transistors, the other of the source and drain of each of the plurality of second transistors is electrically connected to a second power supply node, gates of the plurality of second transistors are electrically isolated from each other, and the first transistor is disposed between the plurality of discharge elements and the plurality of second transistors.

18. The liquid discharge substrate according to claim 17, wherein an effective channel width We and an effective channel length Lc of the first transistor, and an effective channel width Wi and an effective channel length Li of the second transistor satisfy an expression (1):

$$Wc/Lc>Wi/Li \quad (1).$$

19. A liquid discharge substrate comprising:

a plurality of discharge elements;

a first transistor; and a plurality of second transistors, wherein one of a source and drain of the first transistor is electrically connected to a first power supply node, the other of the source and drain of the first transistor is electrically connected to one node of each of the plurality of discharge elements, the other node of each of the plurality of discharge elements is electrically isolated from each other and electrically connected to one of a source and drain of corresponding one of the plurality of second transistors, the other of the source and drain of each of the plurality of second transistors is electrically connected to a second power supply node, gates of the plurality of second transistors are electrically isolated from each other, the first transistor is disposed between the plurality of discharge elements and the plurality of second transistors, an effective channel width Wc and an effective channel length Lc of the first transistor and an effective channel width Wi and an effective channel length Li of the second transistor satisfy an expression (1):

$$Wc/Lc>Wi/Li \quad (1),$$

the liquid discharge substrate further includes a first wiring extending along a first direction in which the plurality of discharge elements are arranged, and forming the first power supply node, and a second wiring extending along the first direction and forming the second power supply node, the first wiring is disposed between the plurality of discharge elements and the second wiring as viewed in plan, a width W1 of the first wiring in a second direction intersecting the first direction is smaller than a width W2 of the second wiring along the second direction, and the first transistor forms a source follower.

* * * * *